US009937547B2

(12) United States Patent
Avrillaud et al.

(10) Patent No.: US 9,937,547 B2
(45) Date of Patent: Apr. 10, 2018

(54) ELECTROHYDRAULIC FORMING DEVICE

(71) Applicant: ADM28 S.àr.l., Luxembourg (LU)

(72) Inventors: Gilles Avrillaud, Pinsaguel (FR); Eran Plaut, Zofit (IL); Hervé Peronnet, Capdenac Gare (FR)

(73) Assignee: ADM28 S.AR.L., Luxembourg (LU)

( * ) Notice: Subject to any disclaimer, the term of this patent is extended or adjusted under 35 U.S.C. 154(b) by 0 days.

(21) Appl. No.: 15/035,987

(22) PCT Filed: Nov. 14, 2014

(86) PCT No.: PCT/IB2014/066045
§ 371 (c)(1),
(2) Date: May 11, 2016

(87) PCT Pub. No.: WO2015/071869
PCT Pub. Date: May 21, 2015

(65) Prior Publication Data

US 2016/0271676 A1 Sep. 22, 2016

(30) Foreign Application Priority Data

Nov. 15, 2013 (FR) ..... 13 61218

(51) Int. Cl.
*B21D 26/12* (2006.01)

(52) U.S. Cl.
CPC ..... *B21D 26/12* (2013.01)

(58) Field of Classification Search
CPC ..... B21D 26/06; B21D 26/08; B21D 26/12
See application file for complete search history.

(56) References Cited

U.S. PATENT DOCUMENTS

| | | | | |
|---|---|---|---|---|
| 3,214,950 | A | 11/1965 | Nemitz | |
| 3,232,085 | A * | 2/1966 | Inoue | B21D 26/12 29/421.2 |
| 3,631,701 | A | 1/1972 | Hertel et al. | |
| 3,643,482 | A | 2/1972 | Hertel et al. | |
| 4,174,624 | A * | 11/1979 | Shrum | F42D 5/04 72/56 |
| 6,591,649 | B1 | 7/2003 | Gafri et al. | |
| 7,493,787 | B2 | 2/2009 | Golovashchenko et al. | |

FOREIGN PATENT DOCUMENTS

| | | |
|---|---|---|
| GB | 1312173 | 4/1973 |

* cited by examiner

*Primary Examiner* — Debra Sullivan
(74) *Attorney, Agent, or Firm* — Seed IP Law Group LLP

(57) ABSTRACT

An electrohydraulic forming device comprising a framework, a tank, a movable enclosure comprising a cover, a mold connected to the cover by a support structure, a forming chamber and a discharge chamber with at least one electrode device. The enclosure is movable between a first position in which the tank is closed by the cover and a second position in which the discharge chamber and the forming chamber are outside the tank.

9 Claims, 4 Drawing Sheets

ELECTROHYDRAULIC FORMING DEVICE

BACKGROUND

Technical Field

The present invention relates to an electrohydraulic forming device.

Description of the Related Art

Processes for manufacturing parts by hydroforming have been used over the past ten years or so in many industries. In fact, thanks to changes in these manufacturing processes, it is now possible to obtain mechanical parts in relatively complex shapes with competitive production costs. Therefore, the automobile and aeronautics industries, for example, use such technologies.

Such a hydroforming process is a process for manufacturing by deformation. It enables the plastic deformation of metal parts with a relatively thin thickness. To carry out this deformation, a fluid is used that enables the deformation of said part on a mold when the fluid is pressurized. Several techniques are used to pressurize the fluid.

One of the processes used is a process called electrohydraulic forming. This process is based on the principle of an electric discharge in the fluid stored in a tank. The amount of electrical energy released produces a shock wave whose propagation in the fluid is very fast and which enables the plastic deformation of the mechanical part against the mold. Electrodes positioned in the fluid thus release the electric charge stored in the energy storage capacitors.

U.S. Pat. No. 6,591,649 presents an electrohydraulic forming device. This device comprises a tank suitable for containing a fluid, a part to be deformed, and a set of electrodes coupled to an electric energy storage device suitable for generating a shock wave. During production phases, this shock wave, which has a relatively strong force, can cause problems with faults on certain parts of the electrohydraulic forming device.

U.S. Pat. No. 3,214,950 presents an apparatus for the deformation of metal sheets and preformed parts under the effect of a shock in water. The deformation is carried out by pressure using shock waves transmitted by the water onto the part to be deformed in a vacuum space of a hollow mold. The apparatus comprises a water container sunk into the ground, a hollow mold and a support frame for an explosive charge. The water tank also comprises a wall composed of U-bolts held together by means of a band at their upper ends and cast in concrete at their lower ends. To protect the tank from shocks, a lower part of the tank is covered in an absorbent material. The use of U-bolts cast in concrete therefore secures the device during the explosion.

In order to generate the shock wave, the electrodes, mold and the part to be deformed are generally positioned at the bottom of the tank and are thus immersed in fluid. Thus, every time the part is changed, the operator must change the part to be formed in a liquid environment.

BRIEF SUMMARY

Therefore the object of the present invention is to provide an electrohydraulic forming device enabling improved production gains in parts manufacturing. In addition, the object of the present invention is to provide an electrohydraulic forming device with improved reliability and life span in relation to devices from the prior art.

Of course, the device proposed will preferably comply with the standards in force and will maintain the characteristics required for industrial applications. Advantageously, it will be easy to use and have a competitive manufacturing cost.

For this purpose, the present invention proposes an electrohydraulic forming device comprising a framework, a tank and a discharge chamber with at least one electrode device and a cover.

According to the present invention this electrohydraulic forming device also comprises a movable enclosure comprising the cover, a mold connected to the cover by support means, a forming chamber and the discharge chamber, said enclosure being movable between a first position in which the tank is closed by the cover and a second position in which the discharge chamber and the forming chamber are outside the tank.

Thanks to the two positions of the movable enclosure, it is possible to access the part to be formed without emptying the fluid stored in the tank. Thus, the production time is improved. In addition, this design also advantageously enables having a liquid and therefore pressure waves situated on top of the part to be formed, which enables having the liquid in contact with the part to be formed, without having to evacuate between the part to be formed and the liquid.

One advantageous form of the invention provides that first damping means are placed between the clamp disks and the cover. In this way, the effect of shock wave propagation in the fluid on the different parts of the device is reduced.

To reduce the impact of shock waves on the device even more significantly, second damping means are placed between the support means and a mold support of the mold.

For the sake of optimizing the life span of the device, third damping means are placed between the cover and the tank, thereby significantly improving the life span of such a device.

To optimize the shock wave damping, the first, second and third damping means are resilient blocks, preferably in rubber.

For the sake of optimizing the deformation of the part, it is important to control and guide the shock wave thus created. To do this, the discharge chamber comprises at least one reflector in a paraboloid shape. The set of reflectors can be, for example in a conical, flat or ellipsoid shape, as needed.

In addition, to maintain the part to be formed in a stable position nearest to the mold, the forming chamber is associated with means for creating a vacuum.

During the creation and propagation of shock waves, the stability of the device is very important to prevent any unintended deformation or breakage of certain parts. To do this, the support means comprise three legs distributed at 120°.

Lastly, to control and optimize the deformation of the part, a distance between the cover and the mold is adjustable, thus modulating the force to which the part to be deformed will be subjected.

BRIEF DESCRIPTION OF THE SEVERAL VIEWS OF THE DRAWINGS

Details and advantages of the present invention will appear more clearly in the following description, done with reference to the appended schematic drawing in which.

DETAILED DESCRIPTION

Figure 1:
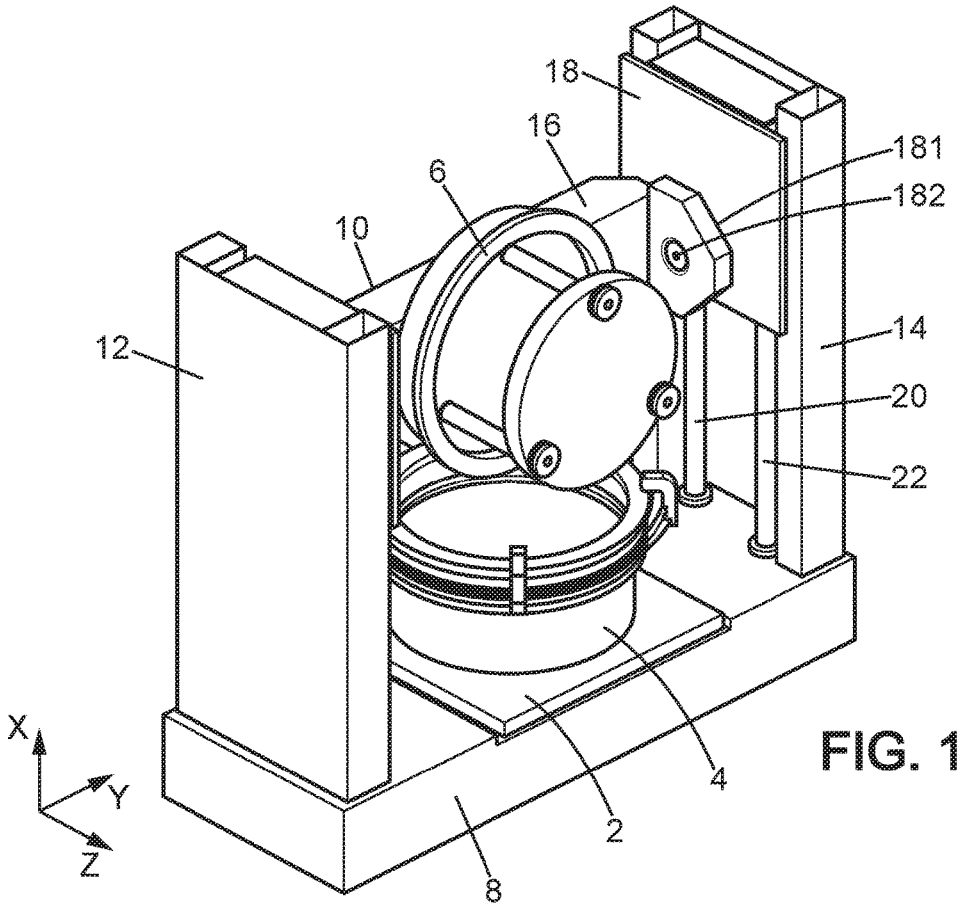
FIG. 1 is an isometric schematic view of an electrohydraulic forming device according to the present invention.

The person skilled in the art would recognize an electrohydraulic forming device in FIG. 1. Such a device comprises a framework 2 suitable for supporting a tank 4. In addition, the electrohydraulic forming device of the invention comprises a movable enclosure 6, an electric energy storage device and an electric pulse generator, both not represented in the figures. The electric energy storage device coupled to the electric pulse generator triggers, following a determined strategy, an electrical discharge process in a liquid stored in tank 4 to structure a part to be formed 5. This process will be presented in further detail later.

The framework 2 is adapted to support tank 4. The tank may be, in one example of embodiment, attached to framework 2 using fixation systems regularly distributed around tank 4. Framework 2 may be made in metal or in a metal alloy such as for example iron or hardened steel. In one example of embodiment, framework 2 is in a parallelepiped shape and has dimensions suitable for being able to support tank 4.

Framework 2 is disposed on a base 8. This base 8 may be in metal or in any other material allowing framework 2 to be placed on said base 8 in order to, for example, not damage the ground where the device is installed. Base 8 also comprises two fixation systems (not represented in the figures) adapted to enable the fixation of a cross-member 10.

The cross-member 10 comprises at least two vertical elements 12 and 14 and at least one horizontal element 16. The vertical elements 12 and 14 are adapted to enable displacement of horizontal element 16 along an x-axis (FIG. 1). In order to not weigh the description down and knowing that vertical element 12 and vertical element 14 are structurally identical, only vertical element 14 will be detailed in the rest of the description.

Vertical element 14 (FIG. 1) comprises a complementary fixation system (not represented in the figures) intended to cooperate with a fixation system of base 8 in order to fix vertical element 14 on base 8. Vertical element 14 also comprises a carriage 18 enabling the displacement of horizontal element 16 along the x-axis. In one example of embodiment, carriage 18 comprises two locations adapted to receive respectively a first ring-threaded shank 20 and a second ring-threaded shank 22.

In one example of embodiment, carriage 18 comprises at least one motor, a supply and control device for said motor and a gear wheel (not represented in the figures). The supply and control device is adapted to deliver electric energy to the motor in order to make the gear wheel turn in one direction or in the opposite direction depending on a determined strategy. Teeth of the gear wheel are placed in grooves of the first ring-threaded shank 20 so that when the motor is activated, the carriage 18 slides along the first ring-threaded shank 20 along the x-axis.

In another example of embodiment, a second motor with its control system as presented previously is disposed on the second ring-threaded shank 22.

It is noted that the vertical element 12 comprises a carriage whose characteristics are identical to those of carriage 18. This embodiment is given by way of example, other examples of embodiment of the displacement means can be made, such as for example a hydraulic jack system.

Carriage 18 comprises an opening 181 adapted to receive a pin 182. In addition, carriage 18 comprises rotation control means (not represented in the figures). The rotation control means comprise, for example, a motor and a gear. The rotation control means are adapted to enable the rotation of the horizontal element 16 along the y-axis depending on the direction of rotation of the motor. To do this, the gear teeth are inserted with the teeth at the periphery of pin 182, thus enabling rotation of horizontal element 16.

Horizontal element 16 is beam-shaped with two bearings at its ends, each receiving a pin 182. Horizontal element 16 is adapted to support the movable enclosure 6 using an adapted fixation system.

Figure 2:
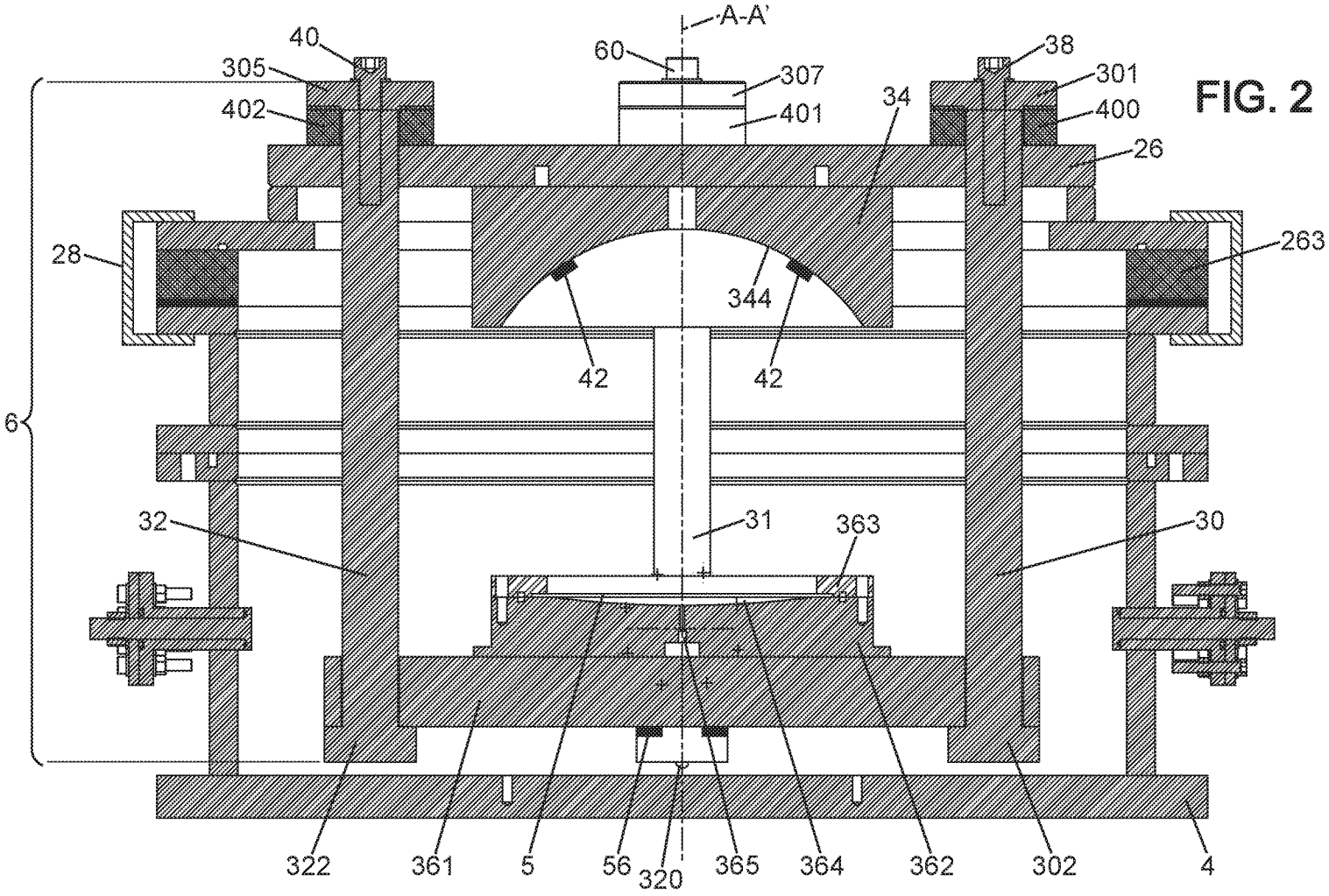
FIG. 2 is an enlarged detail view in a cross-section of the device illustrated in FIG. 1 in another position.

FIG. 2 presents a detailed cross-sectional view of the electrohydraulic forming device. This comprises tank 4, movable enclosure 6 comprising a cover 26, closing means 28, support means formed by three legs 30, 31, 32, a mold 362 and a forming chamber 364.

Tank 4 is adapted to receive and contain a fluid, the fluid is preferentially water. To achieve this, tank 4 is in a material sufficiently resistant to be able to, on the one hand, contain the water stored therein and, on the other hand, resist the shocks or blasts produced during electrical discharges in the water. In one example of embodiment, tank 4 is in metal such as for example steel.

In addition, tank 4 is preferentially in a circular shape with a bottom whose diameter is in line with the dimensions of the parts to be formed. Advantageously, the circular shape of said tank enables an optimal distribution of the shock wave in tank 4 during the electrical discharge and thus enables the life span of tank 4 to be increased.

In another example of embodiment, tank 4 comprises at least one verification window (not represented in the figures) enabling the operator to verify the correct positioning of the part to be formed 5 before launching the process. Tank 4 comprises closing means 28 that are adapted to hold cover 26 on tank 4. These closing means 28 can be made using flanges as represented in FIGS. 1 and 2.

Cover 26 is adapted to cover tank 4 during the sheet forming process. It may be made in a material identical to that of tank 4. It may be made in one or more parts and in one or more materials or alloys compatible with the specifications of said electrohydraulic forming device.

In the embodiment represented in FIG. 2, cover 26 comprises three holes with a diameter suitable for allowing the passage of the three legs 30, 31, 32. These legs are each fixed onto cover 26 by clamp disks 301, 305, 307 and screws 38, 40, 60.

Cover 26 supports, on the one hand, an electrode device 42 on its face directed towards tank 4 and, on the other hand, connection means to fix the cover 26 and also the movable enclosure 6 to the horizontal element 16.

For reasons of machine and human safety, the electrohydraulic forming device may comprise a sealing joint 263 which also serves as a damping means. This sealing joint 263 is placed on an edge of cover 26, which is, in other words, the area of contact between cover 26 and tank 4. Sealing joint 263 is in a material enabling good sealing and damping performance to be obtained, for example in a synthetic and preferentially flexible material.

As the three legs 30, 31, 32 are identical, only leg 30 will be described. The leg 30 is preferentially in the shape of a cylindrical rod (FIG. 2) presenting at a first end a threading to receive a screw 38 and at its other end a head 302 suitable for holding a mold support 361 bearing mold 362. The length of leg 30 is adapted so that mold 362 is at a predetermined distance from the bottom of discharge chamber 344.

In one preferred embodiment, the three legs are distributed at 120°. Therefore, the stability and the sturdiness of the movable chamber 6 are improved.

Discharge chamber 344 comprises electrode device 42 adapted to generate, according to a determined strategy, an electric arc in the water stored in tank 4. The discharge chamber 344 also comprises at least one set of reflectors, preferentially paraboloid-shaped, to direct the pressure waves towards the part to be formed when an electric arc is discharged in the fluid. This embodiment substantially improves the finishing of the formed part. However, depending on the complexity of the part to be formed 5, the set of reflectors may be in conical, flat or ellipsoid shape.

The electrode device 42 comprises at least one set of two electrodes. These are preferentially placed on each side of an axis of symmetry A-A' and at a determined distance, enabling an electric arc to be generated in water. In another embodiment, at least two sets of two electrodes are used. Advantageously, this embodiment enables, at equivalent electrical power (in relation to one set of two electrodes), a more homogeneous deflagration wave in the fluid and therefore a better finishing of the formed part to be obtained. As electrode device 42 and its associated connectors (connecting the electrode device 42 to the pulse generator) are known to the person skilled in the art, they will not be presented in detail here.

Mold 362 is disposed on a mold support 361. Mold support 361 is preferentially in a circular shape with a sufficient diameter to be able to accommodate mold 362. In addition, mold support 361 comprises three holes with a diameter suitable for enabling the passage of legs 30, 31, 32.

Mold 362 is fixed to mold support 361 using screws, for example. In addition, mold 362 comprises an internal pipeline system 365 coupled to a pumping device (not visible in the figures) enabling a desired vacuum under the part to be formed 5 to be obtained in forming chamber 364.

Mold 362 is preferentially in a circular shape and comprises an enclosure corresponding to the part to be formed. Forming chamber 364 corresponds to the space between mold 362 and the part to be formed 5.

Fixation device 363 is positioned opposite mold 362 and holds the part to be formed 5 in the desired position and also seals the forming chamber 364. Ring 363 is fixed using clamping screws to mold 362. The material of ring 363 is preferentially identical to the material of mold 362.

In a variation of embodiment, at least one joint in a flexible material, such as for example a synthetic material, may be inserted between mold 362 and the part to be formed 5 and between the part to be formed 5 and the ring 363.

Advantageously, the distance between the part to be formed 5 and the cover 26 is adapted so that the energy issued by the electric discharge provided by the electrode device 42 in the liquid obtains, in a single step, the desired shape on the part to be formed. In fact, the strong deflagration produces a shock wave that very rapidly displaces in the fluid within a few milliseconds (1 ms=$10^{-3}$s) and brings about the plastic deformation of the part to be formed.

Advantageously, to optimize the deformation of the plate using the electrohydraulic forming process, it is possible to adjust the distance between mold 362 and cover 26. To do this, shims 400, 401, 402 (FIG. 2) are placed between clamp disks 301, 305, 307 and cover 26. To adjust precisely the distance between mold 362 and cover 26, it is possible, in a variation of embodiment, to insert several shims in order to obtain the desired distance.

As explained at the beginning of the description, the electrohydraulic forming device of the invention significantly optimizes the production time between two plate formings. To achieve this, a movable enclosure 6 is proposed that is adapted to be in a first position in which tank 4 is closed by cover 26 and in a second position where movable enclosure 6 is outside of tank 4, giving access to mold 362.

Figure 3A:
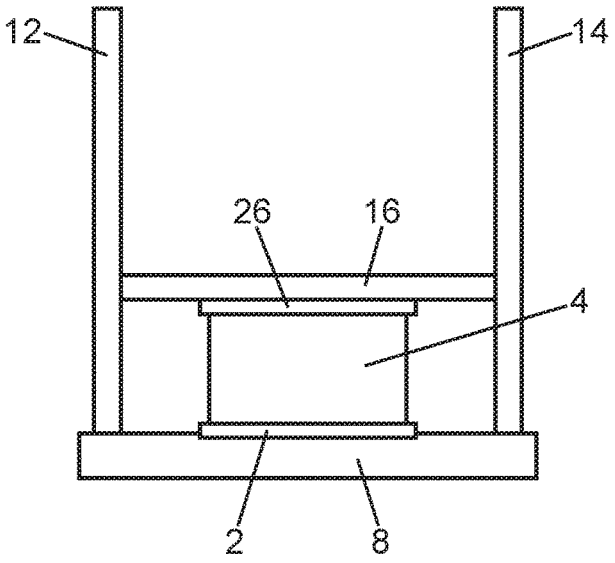
FIG. 3A is a front view of the device from FIG. 1 in the position from FIG. 2.

The first position is represented in FIG. 3A. Here movable enclosure 6 is positioned in tank 4 until cover 26 of movable enclosure 6 is in contact with tank 4 and more specifically with sealing joint 263. It is understood that tank 4 has previously been filled with water to a determined level. In addition, it is possible to top up the water in tank 4 before positioning the movable enclosure 6 in the first position.

Once cover 26 is fixed to tank 4 by fixation means 28, the electrohydraulic forming process can then be executed. The electric energy storage device coupled to the electric pulse generator enables an electric discharge in a liquid stored in tank 4 through the electrode device 42 to structure (according to mold 362) the part to be formed 5. Advantageously, placing discharge chamber 344 in front of mold 362 enables very good finishing and rendering of the part to be formed 5 to be obtained.

Figure 3B:
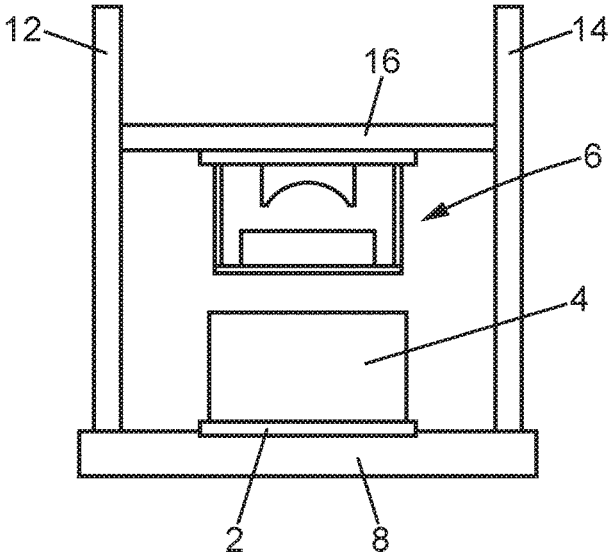
FIG. 3B is a front view of the device from FIG. 1 in a third position.

The second position is represented in FIG. 3B. Here, thanks to cross-member 10 and the associated displacement means, movable enclosure 6 is positioned outside of tank 4. Thus, mold 362 is positioned outside of tank 4. In this position, discharge chamber 344 is outside of the water contained in tank 4, thus enabling the operator to simply install (or replace) the part to be formed.

Advantageously, to eliminate all of the residual water in forming chamber 36, movable enclosure 6 is inclined using cross-member 10 and its displacement means to evacuate the residual water.

Advantageously, thanks to the electrohydraulic forming device such as presented, the handling time between two part forming steps is reduced and changing the parts to be formed on mold 362 is also simplified. Thus, the production costs and also the quality of the parts obtained are improved.

Figure 4:
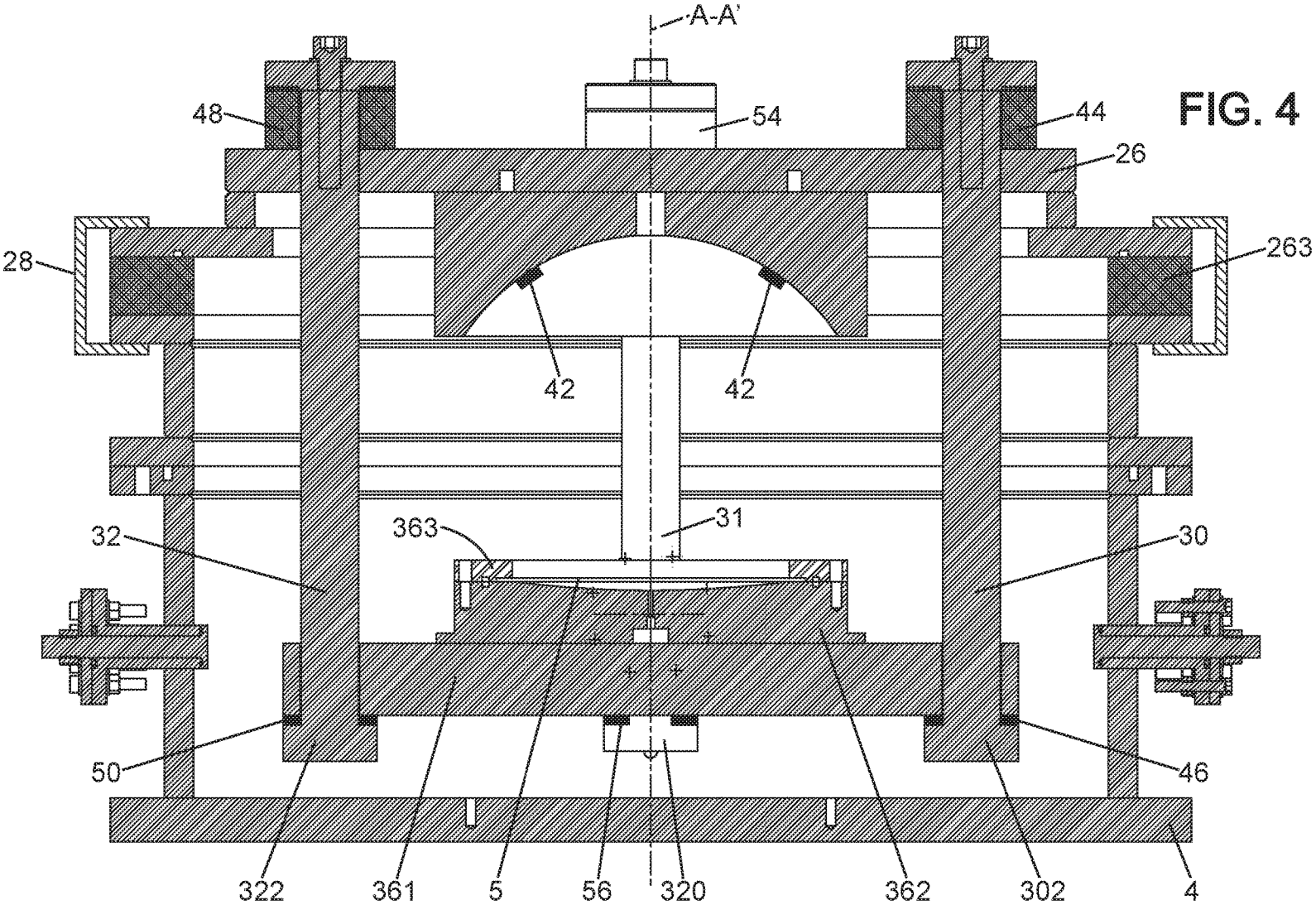
FIG. 4 is a view corresponding to the view from FIG. 2 for a variation of embodiment of the present invention.

To optimize and improve the life span of certain electrohydraulic forming device parts, a preferred embodiment provides first damping means 44, 48, 54, reducing the impact of shock waves on movable enclosure 6 and thus increasing the life span of the device. These first damping means 44, 48, 54 are placed between clamp disks 301, 305, 307 and cover 26 (FIG. 4).

The first damping means 44, 48, 54 are preferentially in the shape of a ring with an outer diameter for example equal to the diameter of clamp disks 301, 305, 307 and an inner diameter adapted to the diameter of legs 30, 31, 32. In addition, the first damping means 44, 48, 54 have a sufficient thickness to enable the partial or total damping of the shock wave generated by the device through the water contained in tank 4.

To attenuate the shock wave in an optimal manner, second damping means 46, 50, 56 placed between mold support 361 and heads 302, 320, 322 of legs 30, 31, 32 are used here. The second damping means 46, 50, 56 are also in the shape of a ring with an outer diameter for example equal to the diameter of heads 302, 320, 322 and an inner diameter adapted to the diameter of legs 30, 31, 32. The thickness of the second damping means 46, 50, 56 is sufficient to enable the partial or total damping of the shock wave.

The first damping means 44, 48, 54 and the second damping means 46, 50, 56 may be, for example, made of a synthetic material. However, any other material or structure enabling the shock wave to be damped may be used.

It is noted that sealing joint 263 is also used as a damping means. Therefore, there are three damping means 263 (FIG. 4), the thickness of which is sufficient for partially or totally absorbing the residual energy during propagation of the wave in the water contained in tank 4.

Advantageously, it is possible to combine, partially or completely, the first damping means 44, 48, 54, the second damping means 46, 50, 56 and the third damping means 263 presented previously. In fact, each of these means acts on a vertical component (FIG. 1, axis AA') of the shock wave. The first damping means 44, 48, 54, the second damping means 46, 50, 56 and the third damping means 263, alone or combined, enable, by attenuating, a slight movement between cover 26 (which supports electrodes 42) and mold support 361 (which contains mold 362). Part of the energy from the shock is thus dissipated by said damping means instead of being fully absorbed by the structure. This enables stresses generated during discharge to be reduced in the parts. In this way, it is possible to reduce masses and thus have a smaller system that is easier and faster to handle and has lower costs.

Therefore the present invention proposes having an electrohydraulic forming device with a suspended enclosure. Thanks to the two positions of the movable enclosure, enabling simplified access to the forming chamber, the handling time is significantly reduced, thus optimizing production costs. In the electrohydraulic forming process, or rather in another process implementing an electrohydraulic discharge, the electrohydraulic pressure propagated in the tank is high and may damage, in certain cases, different parts of the device. Thanks to the damping means, reducing the impact of the shock wave on the different parts of the device and also increasing the life span of the electrohydraulic forming device is possible.

The present invention is not limited to the embodiments described above by way of non-limiting examples and to the shapes represented in the drawings and to other variations mentioned, but the invention relates to any embodiment within reach of the person skilled in the art in the scope of the following claims.

The invention claimed is:

1. An electrohydraulic forming device comprising:

a framework, a tank supported by the framework, a movable enclosure comprising a discharge chamber with at least one electrode device, a cover for the discharge chamber, a support structure, a mold connected to the cover by the support structure, and a forming chamber, said enclosure being movable between a first position in which the tank is closed by the cover and a second position in which the discharge chamber and the forming chamber are outside the tank, wherein the discharge chamber and the forming chamber are positioned in the tank when the movable enclosure is in the first positon and the cover does not close the tank when the movable enclosure is in the second positon.

2. The electrohydraulic forming device according to claim 1, wherein the support structure comprises three legs, the electrohydraulic forming device further comprising:

clamp disks fixing the three legs onto the cover; and dampers placed between the clamp disks and the cover.

3. The electrohydraulic forming device according to claim 1, further comprising:

a mold support configured to support the mold; and dampers placed between the support structure and the mold support.

4. The electrohydraulic forming device according to claim 1, further comprising dampers placed between the cover and the tank.

5. The electrohydraulic forming device according to claim 1, wherein the support structure comprises three legs, the electrohydraulic forming device further comprising:

clamp disks fixing the three legs onto the cover;

first dampers placed between the clamp disks and the cover;

a mold support configured to support the mold;

second dampers placed between the support structure and the mold support; and third dampers placed between the cover and the tank, wherein the first dampers, the second dampers, and the third dampers are resilient blocks.

6. The electrohydraulic forming device according to claim 1, wherein the discharge chamber comprises at least one reflector in a paraboloid shape.

7. The electrohydraulic forming device according to claim 1, wherein the forming chamber is associated with means for creating a vacuum.

8. The electrohydraulic forming device according to claim 1, wherein the support structure comprises three legs distributed at 120° with respect to each other.

9. The electrohydraulic forming device according to claim 1, wherein a distance between the cover and the mold is adjustable.

* * * * *